US007374237B2

(12) United States Patent
Park et al.

(10) Patent No.: US 7,374,237 B2
(45) Date of Patent: May 20, 2008

(54) COLLAPSIBLE SUPPORT FRAME

(75) Inventors: Frederick K. Park, 901 Winstead Ave., Rocky Mount, NC (US) 27804; Paul Brad Forrest, Cary, NC (US)

(73) Assignee: Frederick K. Park, Rocky Mount, NC (US)

( * ) Notice: Subject to any disclaimer, the term of this patent is extended or adjusted under 35 U.S.C. 154(b) by 110 days.

(21) Appl. No.: 11/413,283

(22) Filed: Apr. 28, 2006

(65) Prior Publication Data

US 2007/0252416 A1 Nov. 1, 2007

(51) Int. Cl.
*A47C 4/00* (2006.01)
*A47C 7/00* (2006.01)
*A47D 1/02* (2006.01)

(52) U.S. Cl. ..... 297/16.2; 297/16.1; 297/440.24

(58) Field of Classification Search ..... 297/45, 297/440.24, 16.1, 16.2; 248/200, 150, 155.4, 248/166; 403/320; 135/123, 127
See application file for complete search history.

(56) References Cited

U.S. PATENT DOCUMENTS

| | | | | |
|---|---|---|---|---|
| 933,285 | A | 9/1909 | Blair | |
| 1,348,145 | A | 8/1920 | Arden | |
| 2,705,015 | A | 3/1955 | Langlais | |
| 2,900,158 | A * | 8/1959 | Ditter | 248/166 |
| 3,203,285 | A | 8/1965 | Schmidt | |
| 3,730,544 | A | 5/1973 | Hyman | |
| RE28,067 | E | 7/1974 | Hyman | |
| 4,167,354 | A | 9/1979 | Walker | |
| 4,215,877 | A | 8/1980 | Pritchett | |
| 4,236,711 | A | 12/1980 | Klingbeil | |
| 4,539,786 | A | 9/1985 | Nelson | |
| 4,585,270 | A * | 4/1986 | Singer | 297/16.1 |
| 4,706,696 | A | 11/1987 | Gillis | |
| 4,827,958 | A | 5/1989 | Cantwell et al. | |
| 5,709,428 | A * | 1/1998 | Hugghins | 297/16.2 |
| 5,930,971 | A | 8/1999 | Etheridge | |
| 6,038,802 | A | 3/2000 | Tidwell | |
| 6,062,648 | A | 5/2000 | Adler | |
| 6,378,168 | B1 | 4/2002 | Brady et al. | |
| 6,557,572 | B2 | 5/2003 | Lah | |
| 6,679,644 | B1 | 1/2004 | Heller | |
| 6,980,029 | B1 * | 12/2005 | Vittal et al. | 326/41 |

* cited by examiner

*Primary Examiner*—David Dunn
*Assistant Examiner*—Kaitlin A Wilson
(74) *Attorney, Agent, or Firm*—Coats & Bennett, P.L.L.C.

(57) ABSTRACT

A collapsible support frame includes a plurality of frame structures each having frame members joined together by a tension cable. A locking mechanism pivotably connects the frame structures and allows a user to move the frame structures between a folded position and an unfolded position. In the unfolded position, the frame structure is locked open and may carry a load. In the folded position, the frame structure is collapsed to form a bundle. A slack control member may provide tension to the tension cable when the support frame is unfolded, and to control slack in the tension cable when the support frame is folded.

24 Claims, 12 Drawing Sheets

COLLAPSIBLE SUPPORT FRAME

BACKGROUND

The present invention relates generally collapsible frame structures, and more particularly to collapsible frame structures comprising a plurality of separable frame members held together by an internal cord or cable.

Collapsible frame structures comprising a plurality of frame members that are joined end-to-end and held together by a flexible cord or cable are known. For example, U.S. Pat. Nos. 6,557,572; 4,827,958; 4,706,696 disclose tent poles comprising pole sections held together by an elastic cord. The individual pole sections can be separated and folded over to form a compact bundle for storage. The elastic cord pulls the individual frame members together to facilitate assembly. Similar frame systems may be found in other types of devices as shown by U.S. Pat. No. 6,038,802 (portable displays); U.S. Pat No. 4,215,877 (folding utility carts); and U.S. Pat No. 6,062,648 (folding chairs). Frame structures that rely on an elastic cord to hold the individual sections together are easily assembled but limited in the loads that can be supported.

It is also known to use an inelastic cable, such as a steel cable, to tension a multi-part frame structure as shown in U.S. Pat. Nos. 5,930,971 and 4,167,354. In these patents, a tension cable runs interiorly through individual frame members joined end-to-end and is tightened by means of a tensioning device after the frame is assembled to strengthen the frame. Frames that use an inelastic tension cable can support greater loads, but are not as easily assembled. Further, the tensioning devices tend to be cumbersome to operate.

Accordingly, there is a need for a collapsible frame structure that can support relatively heavy loads, and yet remain easy to assemble.

SUMMARY

The present invention relates to a collapsible support frame comprising a plurality of frame members that are pivotally connected and held together by a flexible member. In one embodiment, the flexible member comprises a non-elastic cable to interconnect the plurality of frame members, which may be segmented. Portions of the non-elastic cable extends interiorly through the plurality of frame members. However, a portion of the non-elastic cable also extends exteriorly to the plurality of frame members. In one embodiment, the non-elastic cable exits the interior of a first frame member through an opening in a sidewall formed in the first frame member, and re-enters the interior of a second frame member through a corresponding opening in a sidewall formed in a second frame member. The openings are formed in their respective sidewalls such that they are spaced away from a pivot connection that pivotally connects the first frame member to the second frame member.

In another embodiment, the collapsible support frame comprises a first frame structure and a second frame structure. Each frame structure includes a first and a second pivotally connected frame member. A locking mechanism is configured to pivotally connect the first and second frame members of each frame structure. The locking mechanism permits a user to lock the collapsible support frame in an unfolded position, and to unlock the collapsible support frame to facilitate folding.

DETAILED DESCRIPTION

Figure 1A:
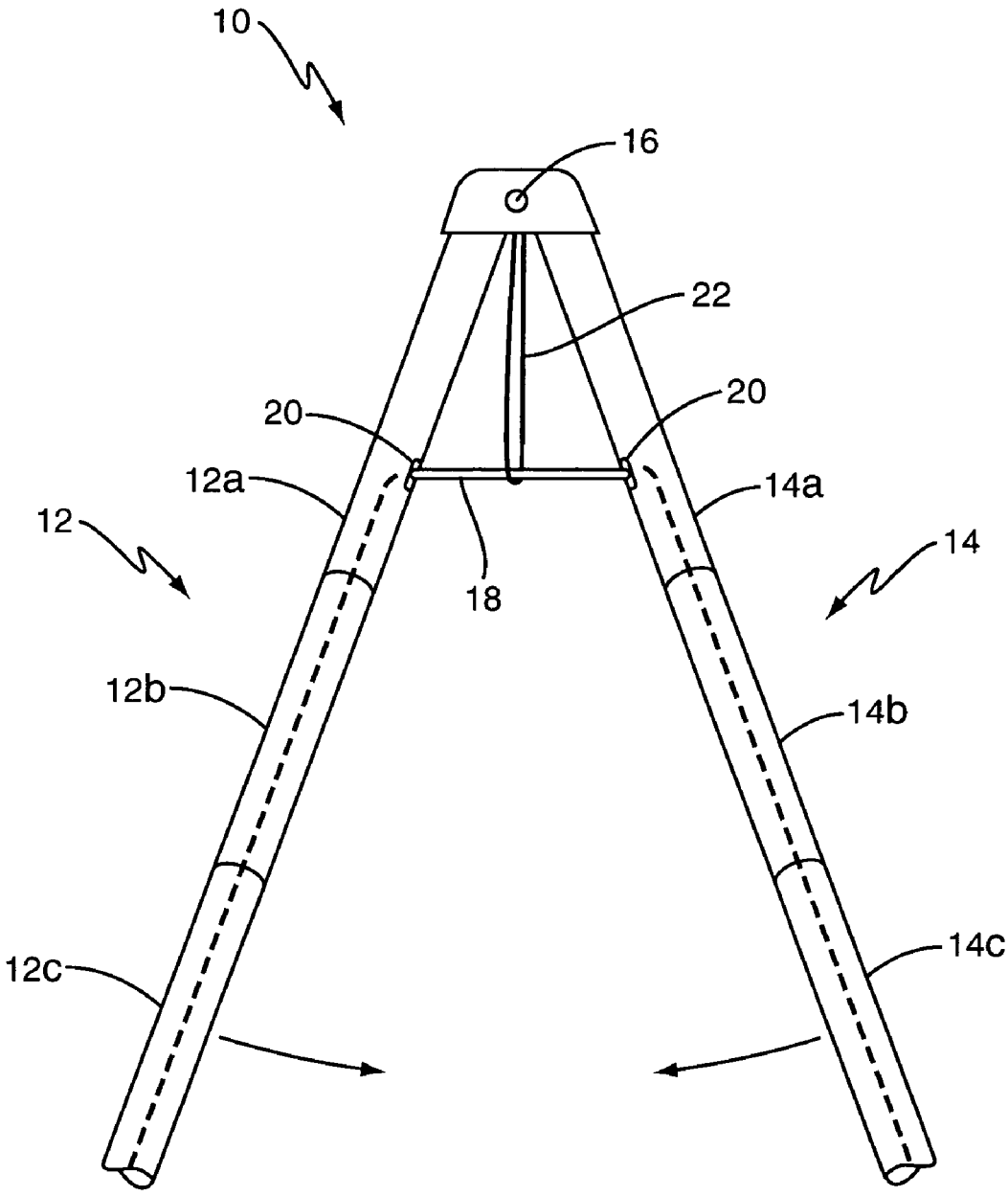
FIGS. 1A-1C illustrate a frame structure according to one embodiment of the present invention.
Figure 1C:
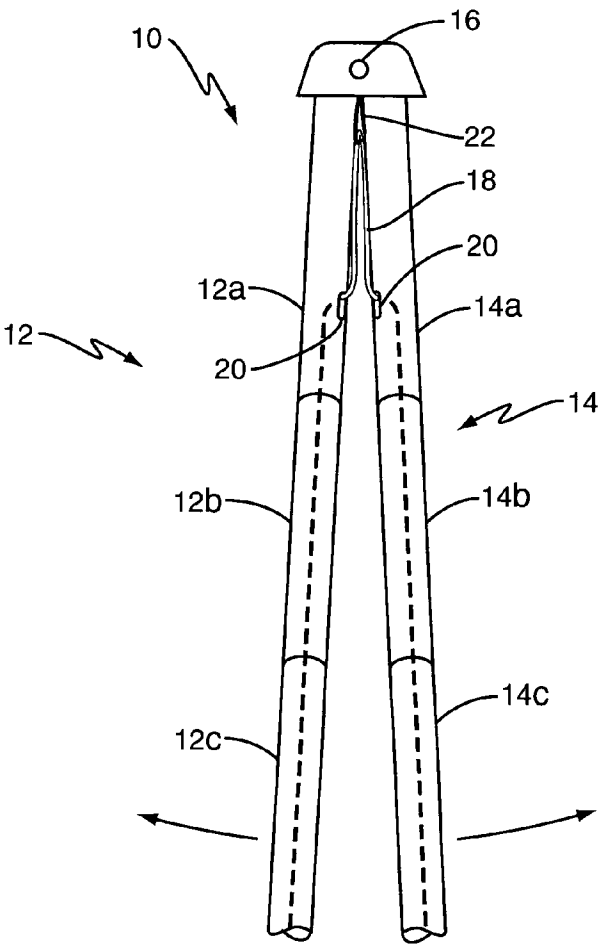
Figure 1B:
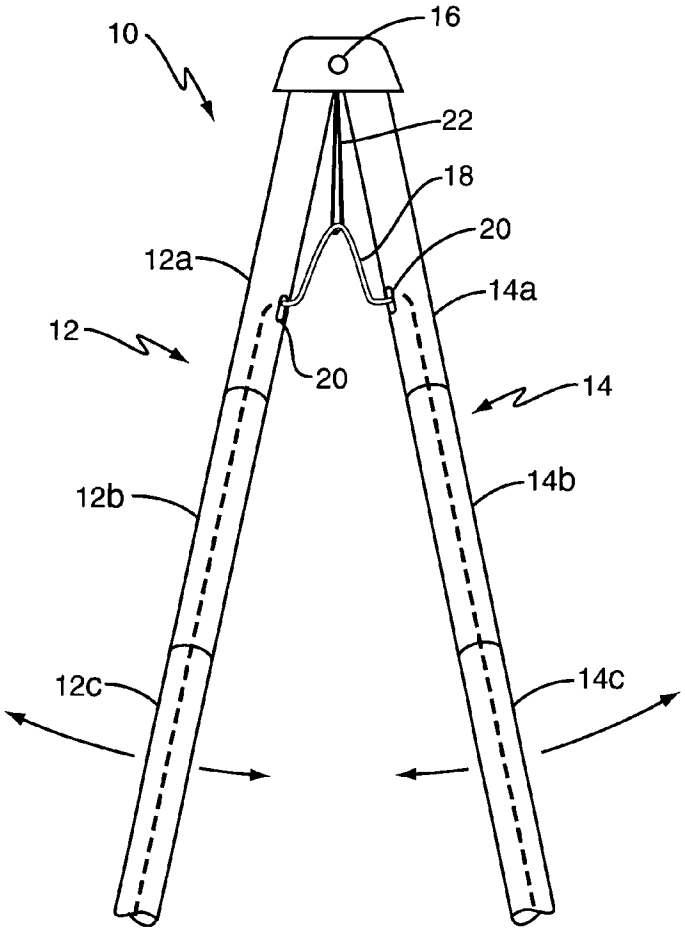

Referring now to the drawings, FIGS. 1A-1C illustrate an exemplary frame structure indicated generally by the numeral 10. Frame structure 10 may be part of a larger collapsible frame structure capable of carrying a load. Examples of such collapsible structures include, but are not limited to, those used for chairs or baby stroller. As described in more detail below, the frame structure 10 is configured to facilitate easy assembly and disassembly or collapse. When assembled, the frame structure 10 may be locked in an open position and able to withstand a load.

Frame structure 10 comprises a pair of pivotally connected frame members 12, 14 that are movable between an open position (FIG. 1A) and a closed position (FIG. 1C). Each frame member 12, 14 includes two or more tubular frame segments 12*a-c* and 14*a-c*, respectively, that connect in end-to-end fashion to form the frame members 12, 14. A pivot member 16 such as a metal pin, for example, pivotally connects the two uppermost frame segments 12*a*, 14*a* such that the frame members 12, 14 form an angle. The pivot member 16 permits a user to pivot the frame members 12, 14 about an axis away from each other to facilitate assembly of the frame structure 10 (FIG. 1A), and towards each other to facilitate folding or collapse of the frame structure 10 (FIG. 1C).

One or more flexible members, such as tension cable 18, hold the frame segments 12*a-c*, 14*a-c* together. The tension cable 18 is a flexible and generally non-elastic cable, such as a flexible polyester braided cord, or steel or carbon fiber cable, that is tensioned when the frame members 12, 14 are unfolded. Tension cable 18 imparts added strength to the frame structure 10 that may be needed for load bearing structures. When folded or collapsed, the tension cable 18 holds the frame segments 12*a-c*, 14*a-c* loosely together to prevent them from becoming separated and lost.

In one exemplary embodiment, tension cable 18 extends both interiorly through each frame segment 12*a-c*, 14*a-c* and exteriorly to the frame members 12, 14. To accommodate the tension cable 18 exiting and re-entering the frame members 12, 14, the sidewalls of each of the two uppermost frame segments 12*a*, 14*a* include an opening 20. The openings 20 are formed such that they generally face each other and are spaced from the pivot member 16. This allows the tension cable 18 to bridge or span the open area or gap between frame members 12, 14.

Because tension cable 18 is a generally flexible and non-elastic cable, it slackens whenever frame members 12, 14 are folded (FIGS. 1B-1C). The slack allows a user to separate the frame segments 12*a-c*, 14*a-c* and collapse the frame structure 10.

To control the slacked tension cable 18 and prevent it from snagging other objects, a slack control member 22 connects the tension cable 18 to a point of the frame structure 10. The slack control member 22 may be, for example, a biasing member such as a spring, or an elastic bungee cord that loops around the portion of tension cable 18 that spans the gap between the frame members 12, 14. The elasticity of the slack control member 22 allows it to stretch when the frame structure 10 is assembled (FIG. 1A); however, its tendency to retract pulls slightly on the tension cable 18, which helps to maintain the tension in the frame structure 10. As the user collapses or folds the frame structure 10 (FIGS. 1B-1C), the slack control member 22 retracts to fold the slack in tension cable 18 between the two frame members 12, 14. This reduces the chance that the tension cable 18 will snag or become snagged on other objects.

Figure 2A:
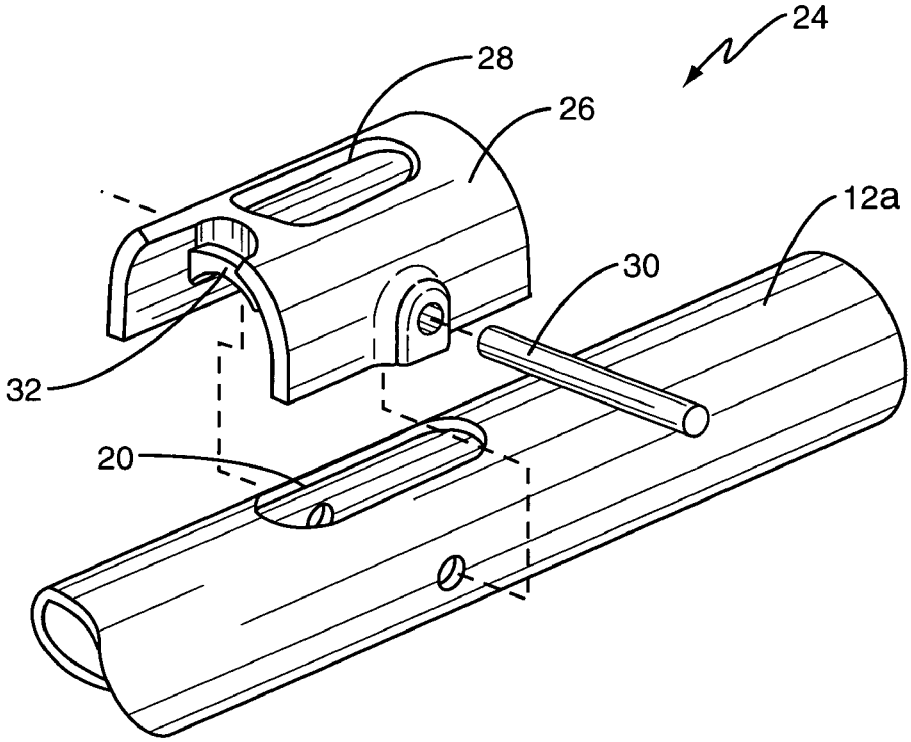
FIGS. 2A-2B illustrate an exemplary grommet that connects to frame members according to one embodiment of the present invention.
Figure 2B:
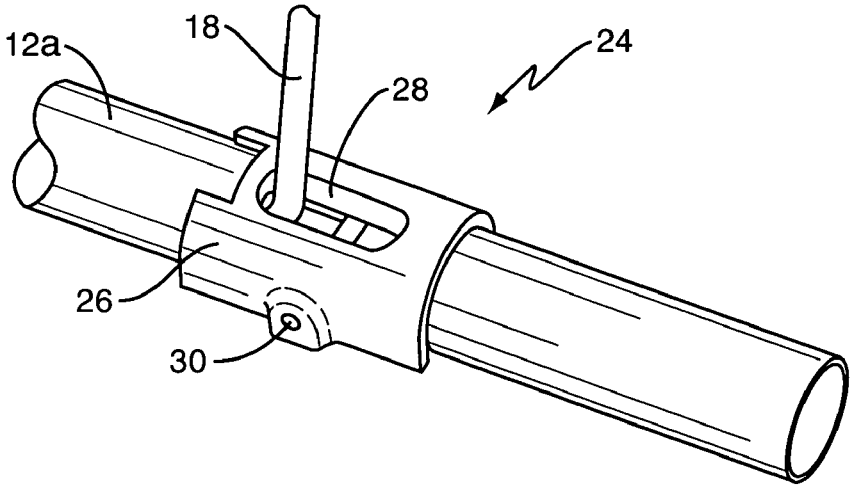

FIGS. 2A-2B illustrate one embodiment of a grommet 24 used to protect the tension cable 18 from damage that might be caused by sharp edges in the openings 20 of frame segments 12*a*, 14*a*. Grommet 24 includes a housing 26, an opening 28, and a connecting pin 30. Housing 26 may comprise a plastic or rubber member, for example, shaped to substantially conform to the exterior sidewall of frame segment 12*a*. In this embodiment, grommet 24 conforms to the tubular shape of frame segment 12*a*, however, any shape is possible. Opening 28 is formed in the housing 26 and is substantially similar in size and shape to the opening 20 formed in the sidewall of segment 12*a*. A tab 32 integrally formed with grommet 24 extends from an underside of housing 26. Tab 32 fits within the opening 20 to assist in maintaining alignment between the openings 20, 28. Opening 28 and tab 32 preferably have smoothed or rounded edges to prevent damage to the tension cable 18 as it exits the interior of frame segment 12*a* (FIG. 2B). Connecting pin 30 fixedly attaches the grommet 24 to frame segment 12*a*. In one embodiment, connecting pin 30 comprises a hardened steel pin that is press fit into the housing 26 of grommet 24 and the sidewall of frame segment 12*a*. Connecting pin 30 may have knurled ends that contact frame segment 12*a* to prevent it from becoming undesirably dislodged from frame segment 12*a*.

Figure 3:
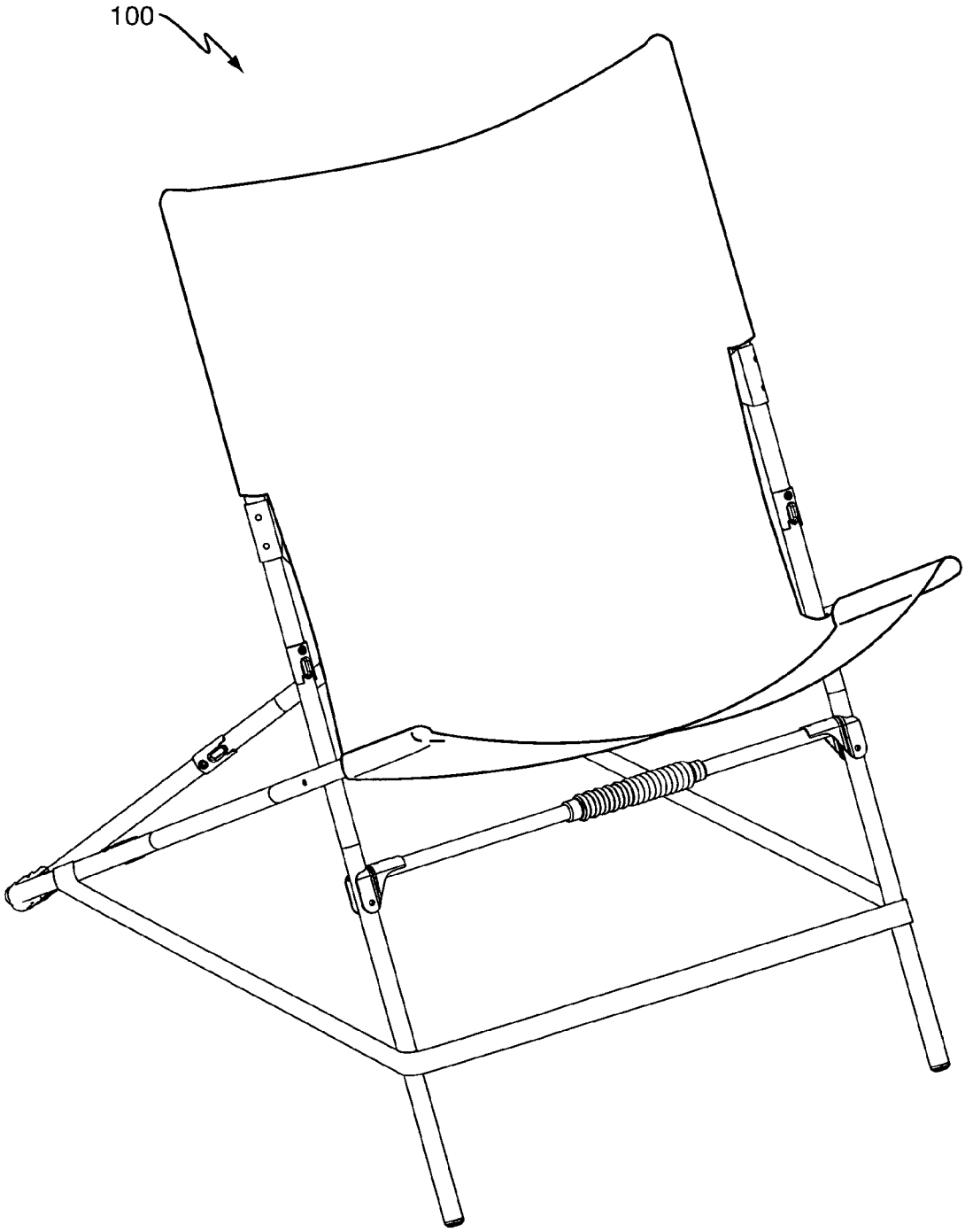
FIG. 3 illustrates a collapsible chair having a support frame according to one embodiment of the present invention.
Figure 4:
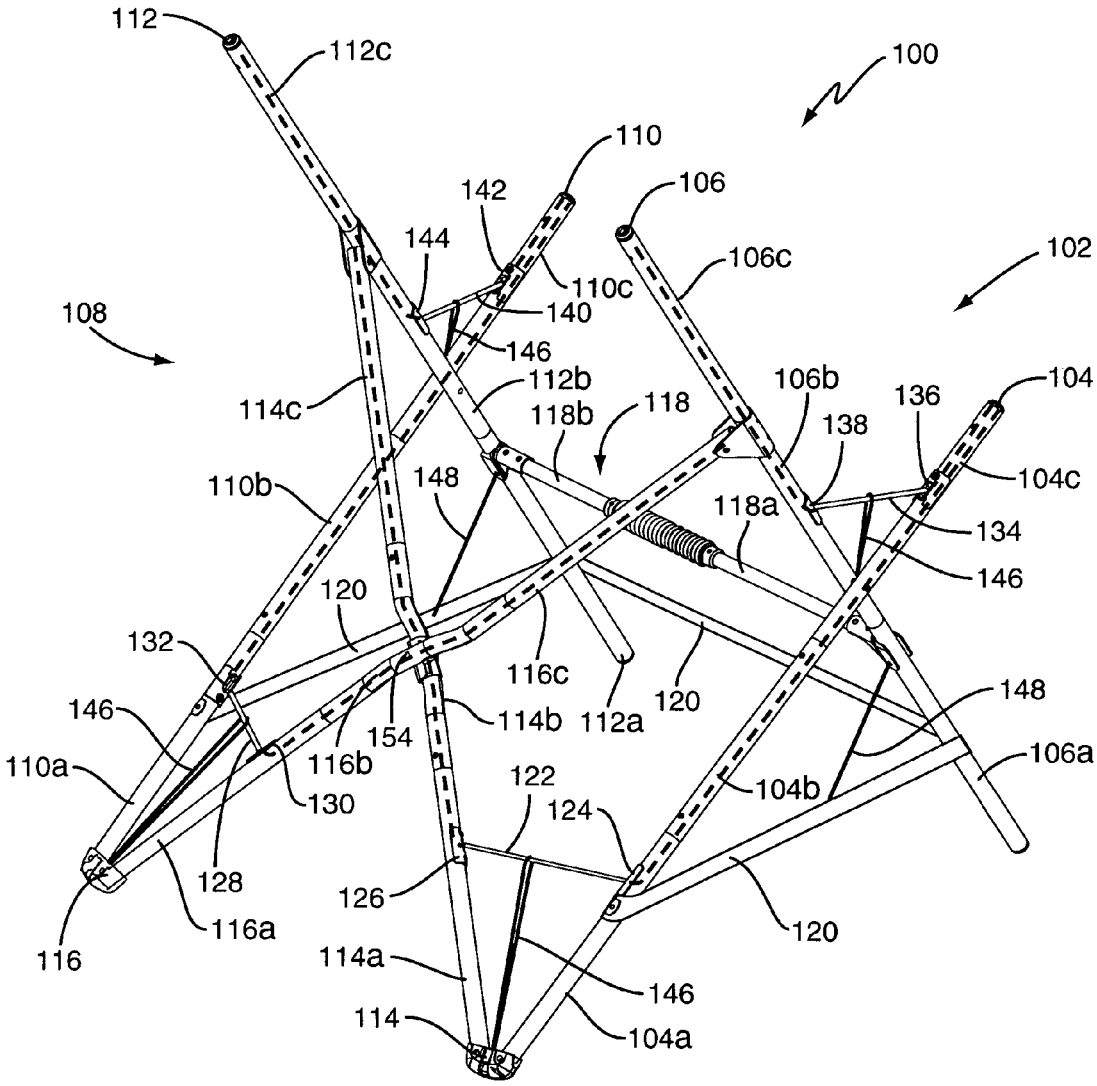
FIG. 4 illustrates an unfolded support frame according to one embodiment of the present invention.
Figure 5:
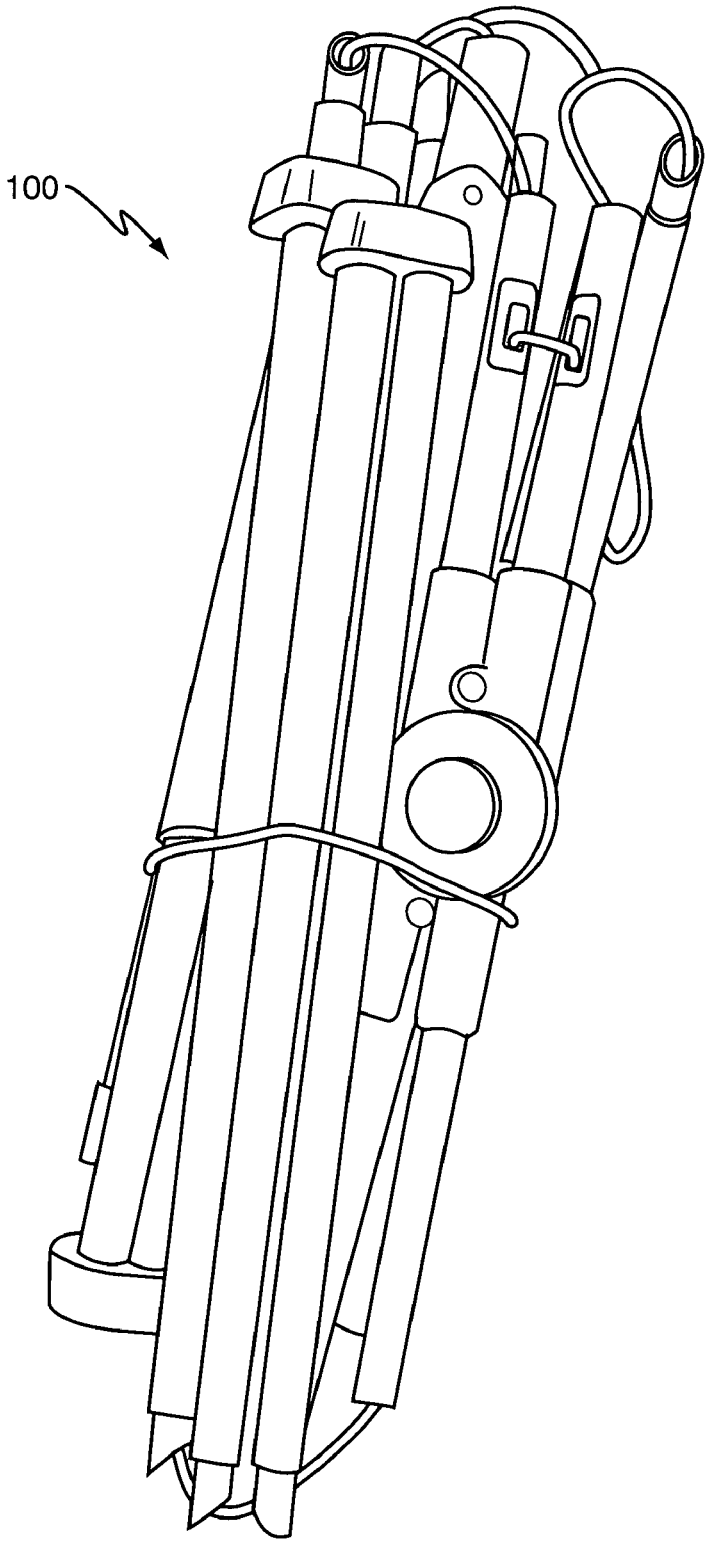
FIG. 5 illustrates a folded support frame according to one embodiment of the present invention.

The frame structure 10 may comprise part of a larger collapsible support frame. FIGS. 3-5 illustrate a support frame 100 for a collapsible chair that incorporates the frame structure 10 shown in FIG. 1. The support frame 100 includes a pair of spaced-apart side frames 102, 108 interconnected by cross members 114, 116 and bracing member 118. Side frame 102 includes frame members 104, 106 which are pivotably connected at an intermediate point. Side frame 108 includes frame members 110, 112 which are also pivotably connected at an intermediate point. Frame members 104, 110 function as the rear legs and seat support of the chair, while frame members 106, 112 function as the front legs and back support of the chair. Cross member 114 is pivotably connected at its lower end to frame member 104 and at the upper end to frame member 112. Cross member 116 is pivotally connected at its lower end to frame member 110 and at its upper end to frame member 106. Bracing member 118 extends between and is pivotally connected to frame members 106 and 112. One or more flexible straps 120 may extend between the frame members.

Each frame member 104, 106, 110, 112 comprises multiple segments that join in end-to-end fashion and are separable from one another. Similarly, cross members 114, 116 and bracing member 118 comprise multiple segments joined in end-to-end fashion that are separable from one another. In this embodiment, frame members 104, 110 include 3 segments each denoted by reference numbers 104*a-c* and 110*a-c* respectively. Frame members 106, 112 comprises 3 segments each denoted by reference numbers 106*a-c* and 112*a-c* respectively. Cross members 114, 116 comprise 3 segments each denoted by reference numbers 114*a-c* and 116*a-c* respectively. Bracing member 118 comprises 2 segments 118*a*, 118*b*. As seen in FIG. 5, the segments allow the support frame 100 to be collapsed and folded into a bundle for storage or transport.

Frame member 104 and cross member 114 comprise a first frame structure 10 as shown in FIG. 1. A first tension cable 122 connects the individual segments of frame member 104 and cross member 114. The tension cable 122 has a first end anchored within frame member 104 and a second end anchored within the cross member 114. Beginning with the first end, tension cable 122 passes interiorly through segments 104*a-c* of frame member 104, exits frame member 104*a* through an opening 124 in frame segment 104*a*, enters cross member 114 through an opening 126 in segment 114*a*, passes interiorly through segments 114*a-c*, and terminates at a second end anchored in segment 114*c* of cross member 114. Thus, when the chair is unfolded, the tension cable 122 holds together the individual segments of frame member 104 and cross member 114. When the chair is folded, the tension cable 122 slackens allowing the individual frame segments to be separated.

Frame member 110 and cross member 116 form a second frame structure 10. A second tension cable 128 has a first end anchored in frame member 110 and a second end anchored in cross member 116. Beginning with the first end, tension cable 128 passes interiorly through frame segments 110*a-c* of frame member 110, exits frame member 110 through an opening 132 in frame segment 110*a*, enters cross member 116 through an opening 130 in segment 116*a*, passes interiorly through segments 116*a-c* of cross member 116, and terminates at a second end anchored in segment 116*c*. When the chair is unfolded, slack is removed from the tension cable 128 such that the tension on the tension cable 128 holds together the individual segments of frame member 110 and cross member 116. When the chair is folded, the tension cable 128 holds together the individual segments of frame member 110 and cross member 116. When the chair is folded, the tension cable 128 slackens allowing the individual frame segments of frame member 110 and cross member 116 to be separated.

In addition, a third tension cable 134 has first and second ends anchored in frame member 104 and 106. Beginning with the first end, tension cable 134 passes interiorly through frame segment 104*c* of frame member 104, exits frame member 104 through an opening 136 in frame segment 104*c*, enters frame member 106 through an opening 138 in segment 106*b*, passes interiorly through segments 106*b-c* of cross member 106, and terminates at a second end anchored in segment 106*c*.

A fourth tension cable 140 follows a similar path interiorly through and exterior to frame members 110, 112. Tension cable 140 passes interiorly through frame segment 110*c* of frame member 110, exits frame member 110 through an opening 142 in frame segment 110*c*, enters frame member 112 through an opening 144 in segment 112*b*, passes interiorly through segments 112*b-c* of cross member 112, and terminates at a second end anchored in segment 112*c*.

As above, slack is removed from the tension cables 134, 140 when the chair is unfolded such that the tension on the tension cables 134, 140 holds together the individual segments of their respective frame members 104, 106, 110, 112. When the chair is folded, the tension cables 134, 140 slacken to allow the individual frame segments of frame members 104, 106, 110, 112 to be separated.

In FIG. 4, a plurality of elastic slack control members 146 control the slack in each of the tension cables 122, 128, 134, 140 to prevent these cables from snagging other objects. The slack control members 146 loop around the part of tension cables 122, 128, 134, 140 that span or bridge the gap between the frame members. Tension in the slack control members 146 pulls slightly on the tension cables 122, 128, 134, 140. This helps to maintain tension in the tension cables 122, 128, 134, 140 when the chair is unfolded, and folds the tension cables 122, 128, 134, 140 between their respective frame members when the chair is folded.

Figure 6:
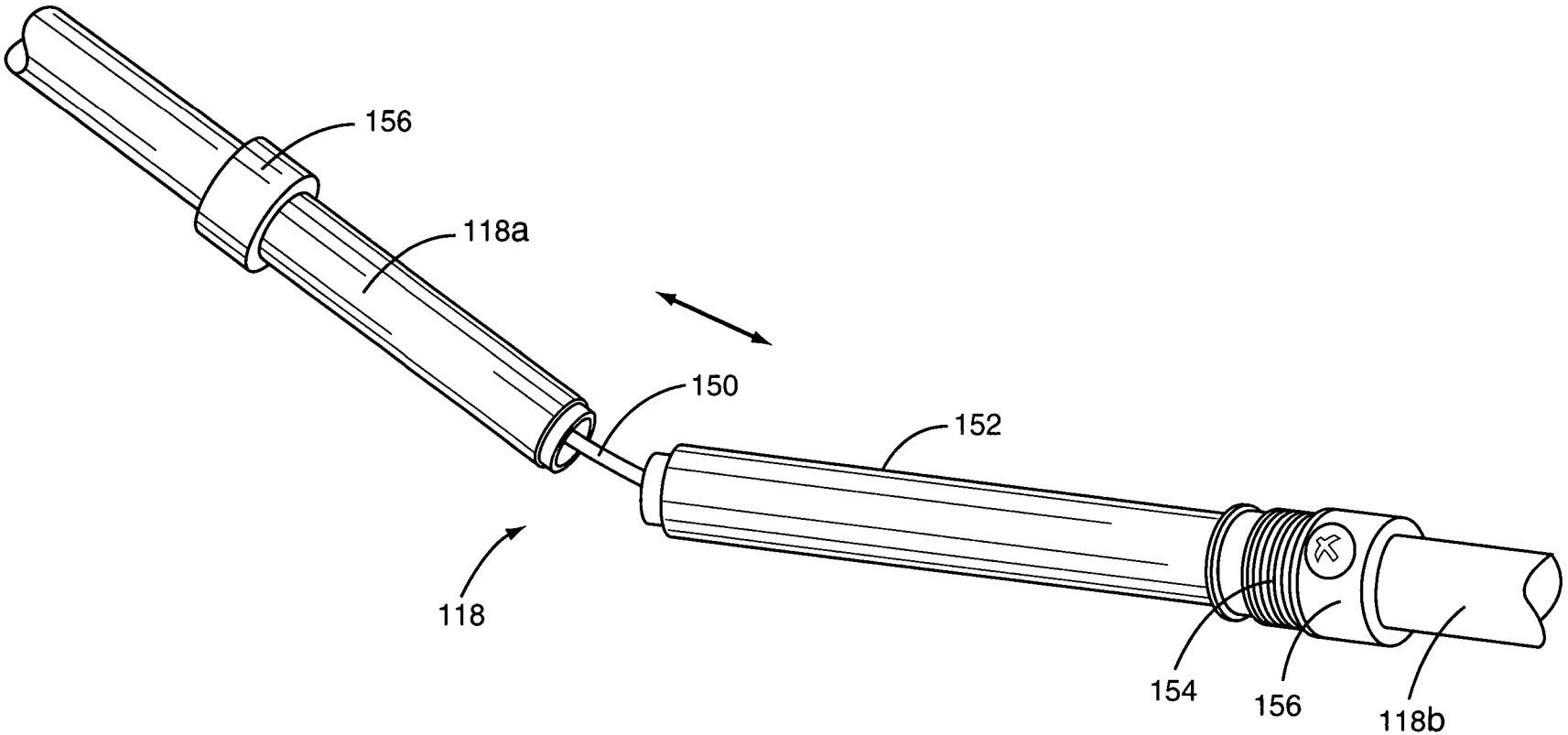
FIG. 6 illustrates an exemplary sliding sleeve that covers a joint between a pair of bracing member segments according to one embodiment of the present invention.

The bracing member 118 comprises two segments 118*a*, 118*b* which are joined together in end-to-end fashion by an elastic cord 150. As best seen in FIG. 6, the elastic cord 150 extends interiorly through each segment 118*a-b*, and has ends that terminate at anchoring points within segment 118*a*, 118*b*. Those skilled in the art will appreciate that the elastic cord 148 stretches and retracts as the segments 118*a*, 118*b* are separated and joined. This helps to maintain tension on the bracing member 118 when the chair is unfolded, and prevents segments 118*a*, 118*b* from separating when the chair is folded.

A sleeve 152 slidingly engages the segments 118*a*, 118*b* to maintain the segments 118*a*, 118*b* in an end-to-end relationship when the chair is unfolded. Sleeve 152 prevents the segments 118*a*, 118*b* from inadvertently separating when it covers the joint between the segments, and allows the segments 118*a*, 118*b* to fold freely when it does not cover the joint between the segments. A biasing member 154 such as a coil spring biases the sleeve 152 to cover the joint when the chair is unfolded. A pair of end caps 156 may be fixedly attached to each segment 118*a*, 118*b* to limit the sliding movement of the sleeve 152.

As previously stated, the frame members 114, 116 are pivotably connected to facilitate folding and unfolding the support frame 100. In the embodiment of FIG. 4, the frame members 114, 116 are pivotably connected at segments 114*b*, 116*b*. Each segment 114*b*, 116*b* comprises a tubular offset frame segment pivotably connected by a mechanical fastener 154 such as a rivet, a bolt, or hardened metal pin. The pivotable connection allows the frame members 114, 116 to pivot towards each other when the chair is being folded, and away from each other when the chair is being unfolded.

Figure 7:
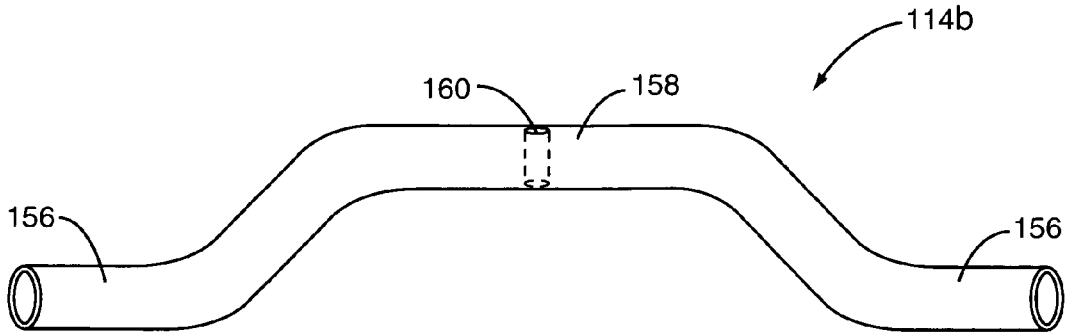
FIG. 7 illustrates one embodiment of a frame member segment suitable for use with one embodiment of the present invention.

FIG. 7 illustrates a close-up view of segment 114*b*, however, it should be understood that segment 116*b* is similar is shape and design. Offset frame segment 114*b* comprises a hollow tube that is open at both ends 156 to receive adjacent frame member segments 114*a*, 114*c*. The ends 156 are preferably formed such that they align with segments 114*a*, 114*c* when connected. An offset section 158 is disposed between the ends 156, and includes a through-hole 160 that receives the mechanical fastener 154.

Figure 8:
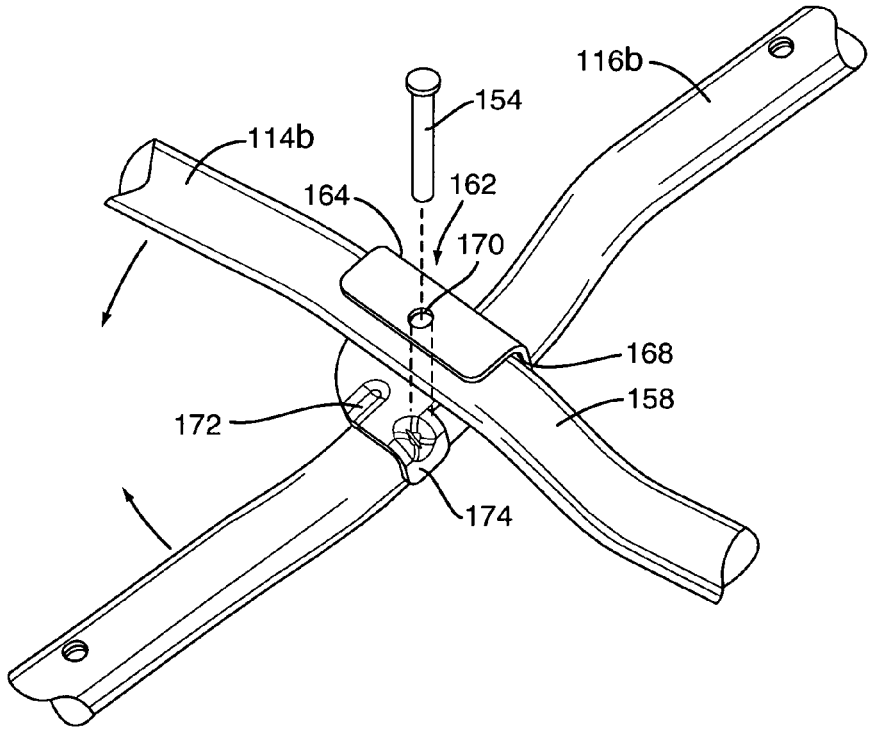
FIG. 8 illustrates a locking mechanism suitable for use in one embodiment of the present invention.

FIG. 8 illustrates one embodiment of a locking mechanism 162 suitable for use with the support frame 100. The locking mechanism 162 may be used to lock the support frame 100 in the unfolded position to prevent inadvertent collapse under a load. In this embodiment, locking mechanism 162 comprises a unitary body 164 having a channel 168, a pair of openings 170, a detent 172, and a stop 174. The channel 168 is sized to receive a portion of the offset section 158 of the offset frame segment 114*b*. The other segment 116*b* extends along a side of the body 164. The mechanical fastener 154 extends through the body 164 and the offset segments 114*b*, 116*b* to pivotably connect the frame members 114, 116 together.

The detent 172 is integrally formed with the body 164 and comprises an arcuate surface that is slightly raised from a surface of the housing 164. The stop 174 is also integrally formed with the body 164 and extends away from the body 164. The detent 172 and the stop 174 are spaced from each other by a distance that is approximately equal to a diameter of one of the offset sections 114*b*, 116*b*. The detent 172 maintains the offset segment 114*b* within the space between the detent 172 and the stop 174 to lock the support frame 100 in the unfolded position. To unlock the locking mechanism 162, the user applies a force sufficient with which to move the segment 114*b* past the detent 174. This causes the frame members 114, 116 to pivot towards each other and allows the chair to be folded.

Returning to FIG. 4, flexible straps 120 are fixedly attached to frame members 104, 106, 110, 112 using mechanical fasteners such as rivets or screws. The flexible straps 120 prevent the frame members 104, 106, 110, 112 from overextending when the chair is unfolded. Because the straps 120 are flexible, this embodiment includes additional slack control members 148 that interconnect the flexible straps 120 to the frame members 106, 112. The slack control member 148 performs substantially the same functionality as that of slack control member 146. In some embodiments, the slack control member 148 is formed as a substantially triangular piece of elastic fabric.

Figure 9:
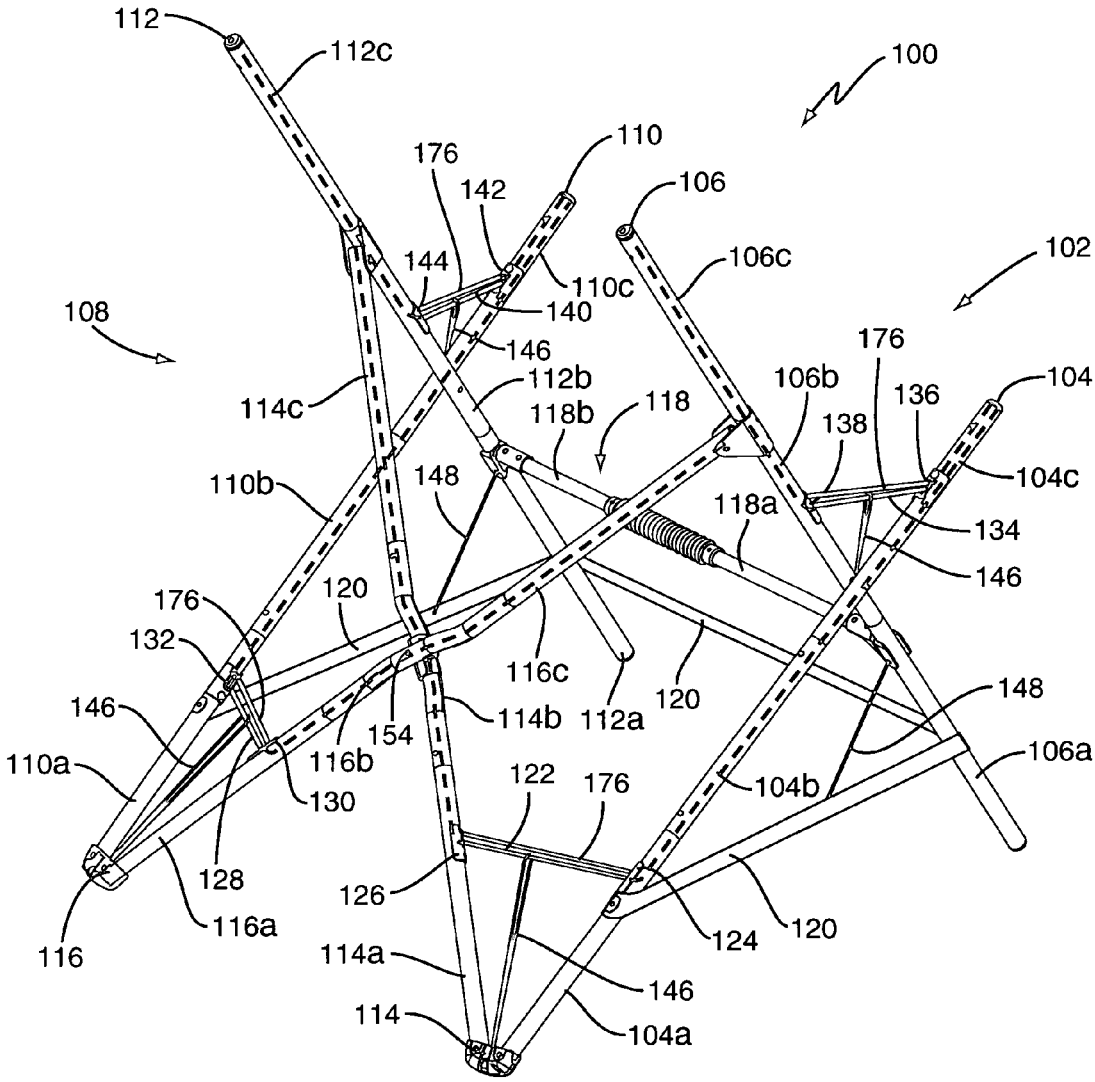
FIG. 9 illustrates an unfolded support frame according to another embodiment of the present invention.
Figure 10:
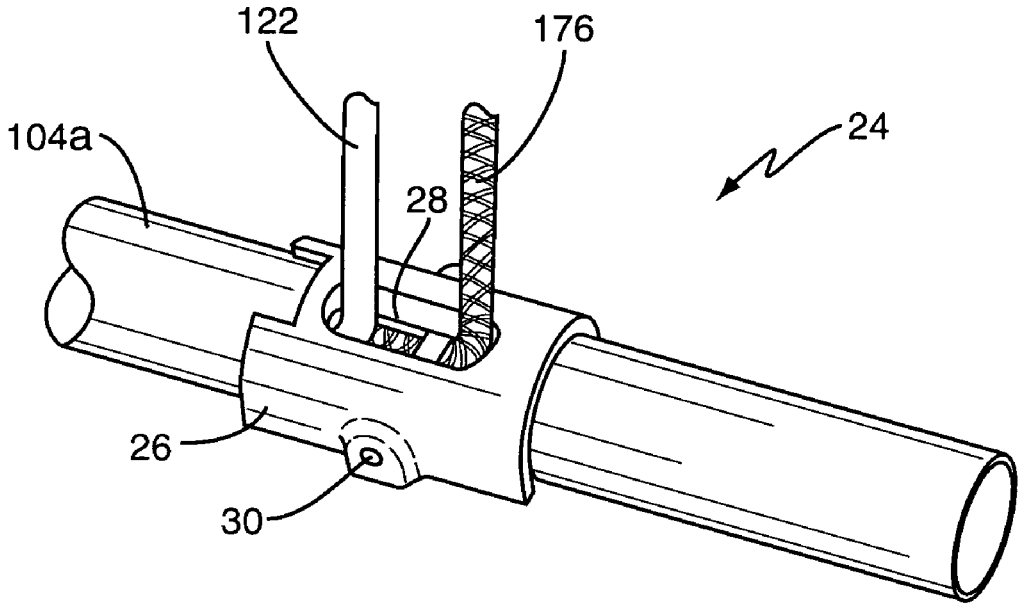
FIG. 10 illustrates another embodiment of a grommet.

In the previous embodiments, only the tension cables 122, 128, 134, 140 are used to tension the support frame 100. In other embodiments, such as the embodiment of FIG. 9, elastic cords 176 may be used to facilitate unfolding and folding the support frame 100. The elastic cords 176 may extend interiorly through and exteriorly to the frame members in a manner similar to that noted above with respect to tension cables 122, 128, 134, 140. The elastic cords 176 provide additional tension that pulls the individual frame segments together when the chair is unfolded, and maintains the individual frame segments together when the chair is folded. As seen in FIG. 10, grommet 24 may be configured to prevent fraying or damaging both the tension cables 122, 128, 134, 140 and the elastic cords 176.

The previous embodiments illustrate the slack control members as looping around a portion of the tension cables that extends exteriorly to the frame members. In other embodiments, such as the one shown in FIGS. 11A-11B, a slack control member 178, which by way of example may be an elastic cord or a biasing member such as a spring, is disposed within the frame structure 10. As above, the frame structure 10 of FIGS. 11A-11B may comprise part of a larger collapsible support frame such as the one previously illustrated.

In this embodiment, frame structure 10 comprises an elastic slack control member 178, a floating connection device 180 that moves interiorly through frame member 12, and a stop 182 to limit the movement of the floating connection device 180. The floating connection device 180 is disposed within the interior of segment 12*c*. One end of the tension cable 18 is anchored to the floating connection device 180 while the opposite end of tension cable 18 is anchored within segment 14*c*. One end of the slack control member 182 is also anchored to the floating connection device 180 while the opposite end of slack control member 182 is anchored within segment 12*c*.

Figure 11A:
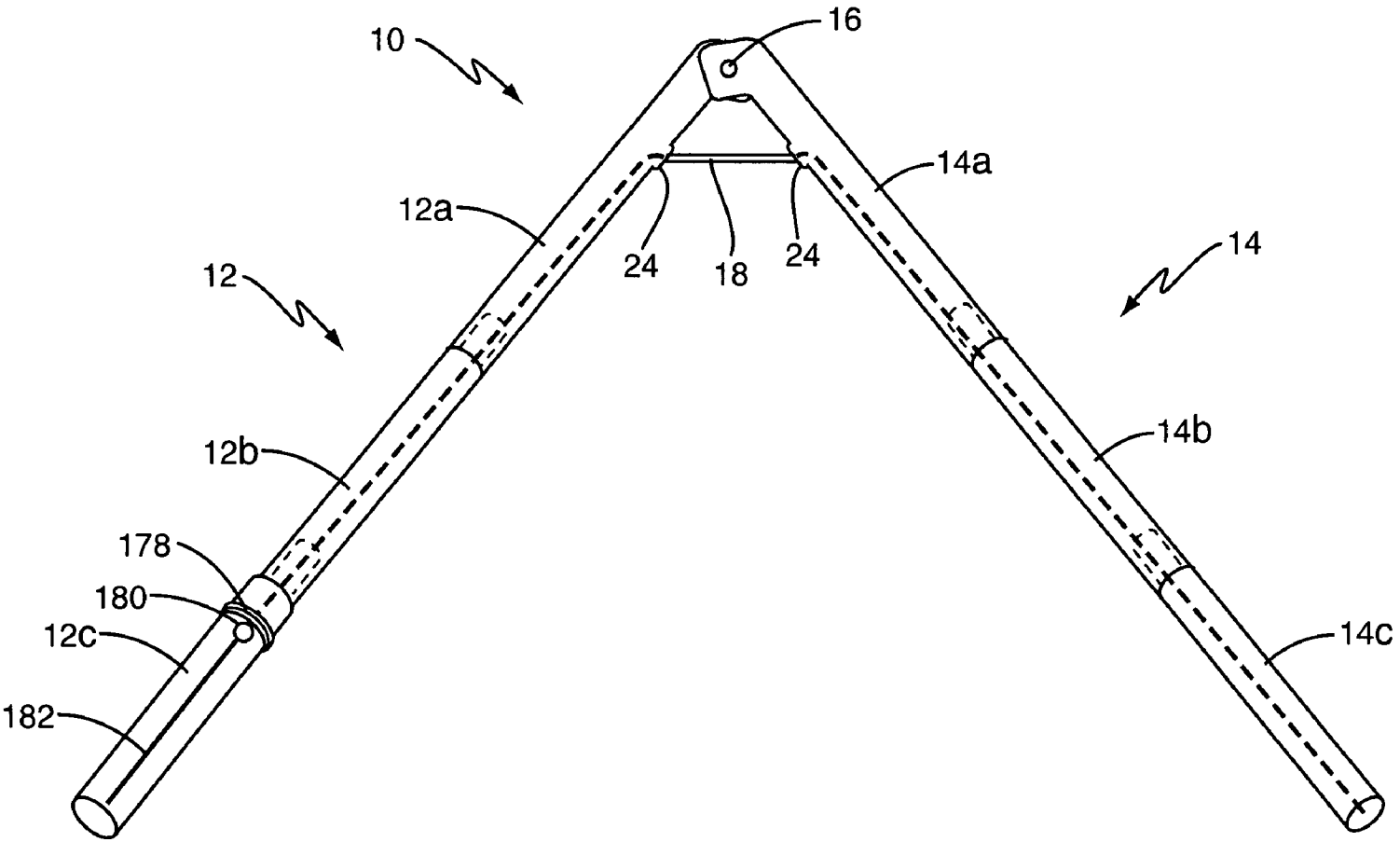
FIGS. 11A-B illustrate a frame structure according to another embodiment of the present invention.
Figure 11B:
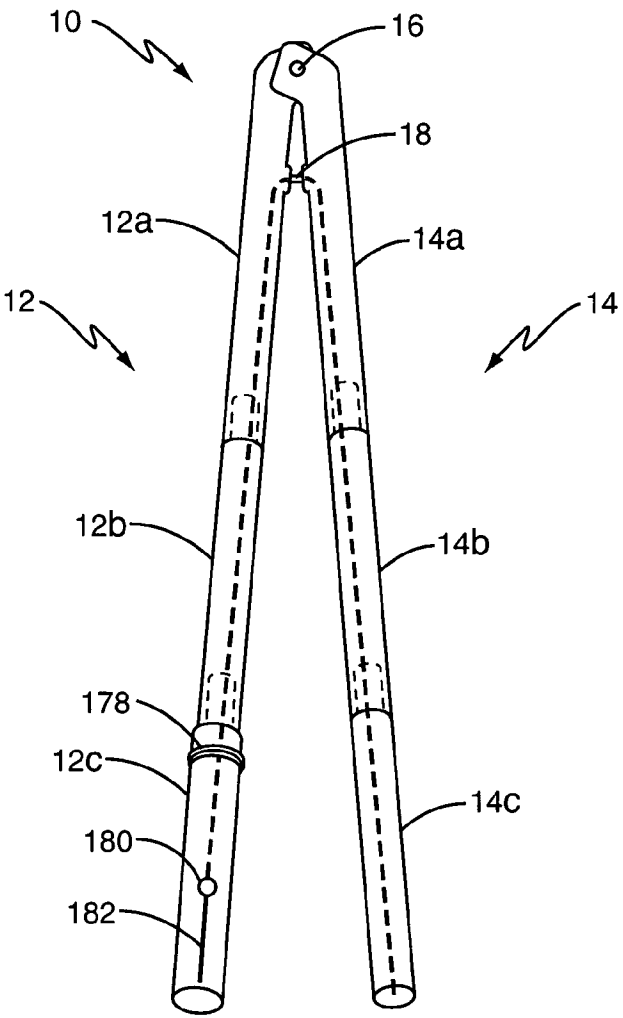

The slack control member 178 stretches and retracts to slacken and tension, respectively, the tension cable 18. This facilitates the folding and unfolding of the frame structure 10. As seen in FIGS. 11A-11B, the elasticity of the slack control member 182 allows it to stretch as the user pivots the frame members 12, 14 towards the unfolded position. However, the tendency of slack control member 182 to retract pulls on the floating connection device 180 and the tension cable 18 to maintain the tension that keeps the individual frame segments 12*a-c*, 14*a-c* together. As the user folds the frame structure 10, the retracting slack control member 182 pulls the slack in tension cable 18 into the interior of frame member 12. When a user separates the segments 12*a-c*, 14*a-c*, the slack control member 182 may stretch slightly; however, the slack control member 182 will retract to maintain the slack in tension cable 18 within the interior of frame member 12.

As seen in the figures, the tension cables and the elastic cords anchor at points within their respective frame members such that one or both extend through multiple segments of the frame members. However, this is not required. the tension cables and/or the elastic cord in any of these embodiments may be anchored at any frame member segment.

Those skilled in the art will recognize that the support frame 100 described herein represents only one exemplary embodiment, and that many variations thereof may be used. The frame structure 10 that is the basis for the support frame 100 can be used in an almost endless variety of structures. Such structures include, but are not limited to, tents and canopies, chairs and tables, strollers, luggage carriers, utility carts, beds and cots, displays, canes and walkers. Therefore, the present invention may be carried out in other specific ways than those herein set forth without departing from the scope and essential characteristics of the invention. The present embodiments are to be considered in all respects as illustrative and not restrictive, and all changes coming within the meaning and equivalency range of the appended claims are intended to be embraced therein.

The invention claimed is:

1. A collapsible support frame comprising:

a first frame member and a second frame member, each comprising a plurality of segments adapted to be joined together;

a pivot member to pivotally connect a first segment of the first frame member to a second segment of the second frame member such that the first and second frame members pivot relative to each other; and a tension cable to tension the first and second frame members, the tension cable having a first portion extending through the first frame member, a second portion extending through the second frame member, and a third portion extending exteriorly to and between the first and second frame members such that the third portion is spaced from the pivot member.

2. The collapsible support frame of claim 1 wherein the tension cable extends through the interior of the first and second frame members such that the tension cable exits the interior of the first frame member through an opening formed in a sidewall of the first segment, and enters the interior of the second frame member through an opening formed in a sidewall of the second segment.

3. The collapsible support frame of claim 2 wherein the openings formed in the sidewalls of the first and second segments are spaced from the pivot member.

4. The collapsible support frame of claim 3 further comprising an elastic cord extending through the interior of the first and second frame members to pull the frame members together when the frame members are aligned.

5. The collapsible support frame of claim 4 wherein the elastic cord exits the interior of the first frame member through the opening formed in the sidewall of the first segment, and enters the interior of the second frame member through the opening formed in the sidewall of the second segment.

6. The collapsible support frame of claim 2 wherein each opening formed in the sidewalls of the first and second segments comprises a grommet to protect the tension cable from being damaged by the sidewalls.

7. The collapsible support frame of claim 1 further comprising a slack control member connecting the tension cable to the frame to tension the tension cable when the collapsible support frame is unfolded, and to control slack in the tension cable when the collapsible support frame is folded.

8. The collapsible support frame of claim 7 wherein the slack control member connects the frame to a portion of the tension cable that extends exteriorly to the frame.

9. The collapsible support frame of claim 7 further comprising a connection mechanism to interconnect the tension cable to the slack control member within the interior of the first frame member.

10. The collapsible support frame of claim 9 wherein the connection mechanism moves through the first frame member as the slack control member stretches and retracts.

11. A collapsible frame for a chair comprising:

first and second frame structures, each frame structure having a collapsible support frame that comprises:

a first frame member pivotally attached to a second frame member and movable between an unfolded position and a folded position;

a tension cable configured to tension the first and second frame members, the tension cable comprising:

a first portion extending through the first frame member;

a second portion extending through the second frame member; and a third portion extending exteriorly to and between the first and second frame members such that the third portion is spaced from a pivot member that pivotally attaches the first and second frame members; and a unitary locking mechanism to pivotally connect the first frame structure to the second frame structure, and to lock the frame structures in the unfolded position.

12. The collapsible support frame of claim 11 wherein the locking mechanism comprises a channel that receives a segment of the first frame structure.

13. The collapsible support frame of claim 12 wherein the locking mechanism further comprises an integrally formed stop that limits the movement of the second frame structure towards the unfolded position.

14. The collapsible support frame of claim 12 wherein the locking mechanism further comprises an integrally formed detent that resists the movement of the second frame section towards the closed position.

15. The collapsible support frame of claim 11 wherein the tension cable exits and enters the interior of the frame members through openings formed in sidewalls of the frame member, the openings being spaced from the pivot member that pivotally connects the first and second frame members.

16. The collapsible support frame of claim 15 wherein the tension cable comprises a first non-elastic cable that extends interiorly through and exterior to the first and second frame members of the first frame structure, and a second non-elastic cable that extends interiorly through and exterior to the first and second frame members of the second frame structure.

17. The collapsible support frame of claim 15 further comprising a first elastic cord that extends interiorly through and exterior to the first and second frame members of the first frame structure, and a second elastic cord that extends interiorly through and exterior to the first and second frame members of the second frame structure.

18. The collapsible support frame of claim 11 further comprising a slack control member to control slack in the tension cable when the first and second frame structures are in the folded position, and to maintain tension in the tension cable when the first and second frame structures are in the unfolded position.

19. The collapsible support frame of claim 18 wherein the slack control member connects the frame structure to a portion of the tension cable that extends exteriorly to the frame structure.

20. The collapsible support frame of claim 18 further comprising a connection mechanism to interconnect the tension cable to the slack control member within the interior of the first frame structure.

21. The collapsible support frame of claim 20 wherein the connection mechanism moves through the first frame structure as the slack control member stretches and retracts.

22. The collapsible support frame of claim 11 wherein the first and second frame structures are pivotally connected to form a support frame for a collapsible chair.

23. The collapsible support frame of claim 11 further comprising a segmented bracing member.

24. The collapsible support frame of claim 23 further comprising a sleeve that slidingly engages the segments of the bracing member to cover and uncover a joint between the segments.

* * * * *